US005936180A

United States Patent [19]

Ando

[11] Patent Number: 5,936,180

[45] Date of Patent: Aug. 10, 1999

[54] WAVEFORM-DATA DIVIDING DEVICE

[75] Inventor: Tokiharu Ando, Hamamatsu, Japan

[73] Assignee: Yamaha Corporation, Hamamatsu, Japan

[21] Appl. No.: 08/393,285

[22] Filed: Feb. 23, 1995

[30] Foreign Application Priority Data

Feb. 24, 1994 [JP] Japan ..... 6-049926

[51] Int. Cl.[6] ..... G10H 7/00

[52] U.S. Cl. ..... 84/604; 84/603; 84/616

[58] Field of Search ..... 84/603, 604, 605, 84/606, 607, 615, 616, 617, 477 R, 478, 453, 454

[56] References Cited

U.S. PATENT DOCUMENTS

| | | | |
|---|---|---|---|
| 4,461,199 | 7/1984 | Hiyoshi et al. | 84/1.19 |
| 4,584,921 | 4/1986 | Wachi | 84/605 |
| 4,991,484 | 2/1991 | Kawashima | 84/603 |
| 5,038,658 | 8/1991 | Tsuruta et al. | 84/461 |
| 5,298,675 | 3/1994 | Nishimoto et al. | 84/622 |
| 5,361,673 | 11/1994 | Kira et al. | 84/615 |
| 5,446,237 | 8/1995 | Abe et al. | 84/617 |
| 5,521,322 | 5/1996 | Morikawa et al. | 84/603 |

FOREIGN PATENT DOCUMENTS

| | | |
|---|---|---|
| 2-31395 | 7/1990 | Japan . |
| 4-161989 | 6/1992 | Japan . |

*Primary Examiner*—William M. Shoop, Jr.
*Assistant Examiner*—Marlon Torriano Fletcher
*Attorney, Agent, or Firm*—Graham & James LLP

[57] ABSTRACT

A waveform-data dividing device, employed by an electronic musical instrument providing a waveform memory, is used to automatically divide waveform data into registers. The device provides a division-data table in which a plurality of division data are respectively written at locations which are arranged in connection with the registers. When a new waveform is inputted so that corresponding new waveform data are stored in the waveform memory, one division data is created based on the waveform data and is written into the division-data table at the location which is determined responsive to a pitch of the waveform data. Herein, one new waveform is divided into multiple sections so that detection of pitch is performed with respect to each of the sections. When the same pitch is detected with respect to two consecutive sections, that pitch is used as the pitch representing the waveform data as a whole. If the location of the division-data table corresponding to the pitch of the new waveform has been already occupied by another waveform, the other waveform is changed with the new waveform. Further, a manner of waveform division, illustrating multiple registers into which multiple waveforms are respectively divided, is visually displayed on a screen of a visual display unit. If an operator designates one register whose waveform should be changed, at least one candidate waveform is automatically indicated so that the waveform of the register designated is changed with the candidate waveform selected by the operator.

15 Claims, 7 Drawing Sheets

WAVEFORM-DATA DIVIDING DEVICE

BACKGROUND OF THE INVENTION

1. Field of the Invention

The present invention relates to a waveform-data dividing device which is used to divide waveform data to registers so that the waveform data are stored by a waveform memory of an electronic musical instrument in connection with the registers.

2. Prior Art

The electronic musical instruments conventionally known employ waveform memories as sound sources. The waveform memory stores waveform data which are obtained by sampling sound waveforms. The electronic musical instrument of waveform-memory type has a tendency in which as the original pitch indicative of the waveform data becomes lower than the relative pitch indicative of the musical tone to be produced, each of intervals of time used for sampling the sound waveform becomes more rough, which eventually causes a problem that the quality of the musical tone to be produced will be deteriorated. On the other hand, if the musical tone is reproduced using a certain register whose pitch is higher than the original pitch, the electronic musical instrument suffers from another problem that when raising the relative pitch too high, high-frequency components, contained in the waveform data stored by the waveform memory, are somewhat folded back so that so-called "folded noises" (or "reflected noises") may occur.

Due to the above-mentioned reasons, the electronic musical instrument of the waveform-memory type is designed such that the overall frequency range, containing all of the pitches which are produced by the keyboard, is divided into multiple frequency ranges, which are called "registers", so that certain waveform data are stored by the waveform memory in connection with a certain register. Thus, the electronic musical instrument controls the relative pitch such that the relative pitch does not become too high or too low as compared to the original pitch.

Meanwhile, the electronic musical instrument of sampling-sound-source type is known as a "sampler". This sampler uses a random-access memory (i.e., RAM), whose data can be rewritten, as the waveform memory. Hereinafter, this RAM will be called a waveform RAM. The waveform data supplied by the external device or the like are written into the waveform RAM, so that the waveform RAM in which desired waveform data are written is used as the sound source by which desired musical tones are produced. Because of the reasons described before, the sampler is designed such that a specific register is set for the waveform data.

Specifically, the user of the sampler should manually set a specific tone pitch and a specific register on the waveform data before or after storing the waveform data. When the musical tone is produced directly using the waveform data read from the waveform RAM, a deviation frequently occurs between the pitch designated by the user and the pitch of the musical tone produced. Therefore, it is necessary for the user to manually correct or eliminate such deviation.

The above-mentioned register setting method conventionally employed by the sampler requires the user to manually input the pitch and register with respect to the waveform data stored by the waveform RAM. Such manual input operations are troublesome for the user.

Since the deviations in pitch should be successively sensed by the user so that the user is requested to correct them manually, the input operations become complicated and much time is required.

SUMMARY OF THE INVENTION

It is an object of the present invention to provide a waveform-data dividing device which is capable of automatically dividing the waveform data, stored by the waveform memory, into the registers.

The present invention provides a waveform-data dividing device which operates in association with an electronic musical instrument providing a waveform memory. The waveform-data dividing device contains a division-data table in which a plurality of division data are respectively written at locations which are arranged in connection with registers. When a new waveform is inputted so that corresponding new waveform data are stored in the waveform memory, one division data is created based on the waveform data and is written into the division-data table at the location which is determined responsive to a pitch of the waveform data, whereby the new waveform is automatically divided into the register corresponding to the pitch of the waveform data. Herein, the pitch is detected by analyzing the waveform data. If the location of the division-data table corresponding to the pitch of the new waveform has been already occupied by another waveform, the other waveform is changed with the new waveform.

Further, a manner of waveform division, Illustrating multiple registers into which multiple waveforms are respectively divided, is visually displayed on a screen of a visual display unit. If an operator designates one register whose waveform should be changed, at least one candidate waveform is automatically indicated so that the waveform of the register designated is changed with the candidate waveform selected by the operator.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

[A] Hardware configuration

Now, the overall configuration of the electronic musical instrument providing a waveform-data dividing device of this invention will be described with reference to FIG. 1.

Figure 1:
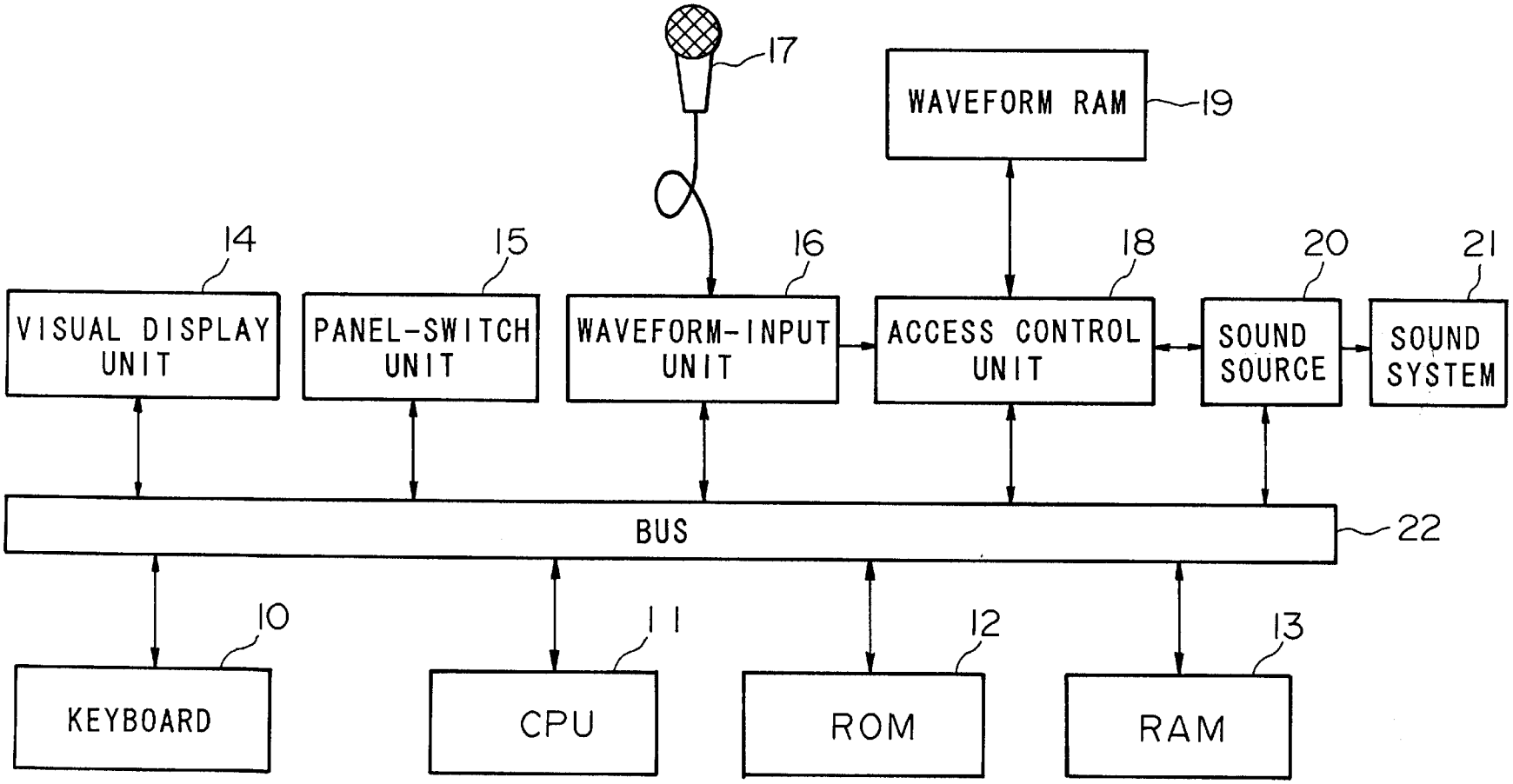
FIG. 1 is a block diagram showing an overall configuration of an electronic musical instrument providing a waveform-data dividing device according to an embodiment of the present invention.

The electronic musical instrument shown by FIG. 1 comprises a keyboard 10, a microprocessor 11 which acts as a central processing unit (i.e., CPU), a read-only memory (i.e., ROM) 12, a RAM 13, a visual display unit 14, a panel-switch unit 15, a waveform-input unit 16, a microphone 17, an access control unit 18, a waveform RAM 19, a sound source 20, a sound system 21 and a bus 22. Herein, the CPU 11 performs a variety of controls associated with the read/write operations of the waveform data as well as certain kinds of controls on the designation of sound-generation/sound-mute operations or the like. The ROM 12 stores programs used by the CPU 11 as well as "preset" tone-color data and the like. The RAM 13 contains a work area for the CPU 11 as well as other storage areas which store tone-color data set by the user, a division-data table and the like. The panel-switch unit 15 provides a variety of panel switches, wherein one switch is provided to designate the sampling operation for the waveform data. The waveform-input unit 16 is provided to perform the sampling operation on the waveform inputted and to write the sampling data (i.e., waveform data) into the waveform RAM 19. The access control unit 18 controls access to the waveform RAM 19. The sound source 20 reads out the waveform data designated from the waveform RAM 19 so as to produce musical tone data which are obtained by effecting tone-color changing processing and/or envelope imparting processing on the waveform data. The musical tone data are supplied to the sound system 21 wherein they are amplified. The sound system 21 provides speakers by which the musical tones corresponding to the musical tone data amplified are produced. The bus 21 is provided to transmit data from each section of the electronic musical instrument.

Now, when the user operates a certain switch, provided in the panel-switch unit 15, so as to start the sampling operation, an analog musical tone signal, representative of a certain sound collected by the microphone 17, is subjected to sampling operation by the waveform-input unit 16 so that digital signals (i.e., waveform data) are created. The waveform-input unit 16 creates the waveform data together with their write addresses; and they are supplied to the waveform RAM 19 through the access control unit 18. Thus, the waveform data are written into the waveform RAM 19 at the write addresses. Then, writing operations for the waveform data are terminated by operating a switch to stop the sampling operation in the panel-switch unit 15 or they are stopped after a certain time has been passed away. In the writing operations, the access control unit 18 continuously selects data from the waveform-input unit 16 so that the data selected are successively supplied to the waveform RAM 19.

Figure 2A:
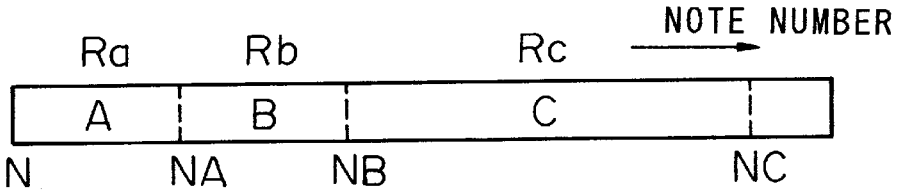
FIGS. 2A to 2C are drawings which are used to explain a manner of waveform division according to the present invention.
Figure 2B:
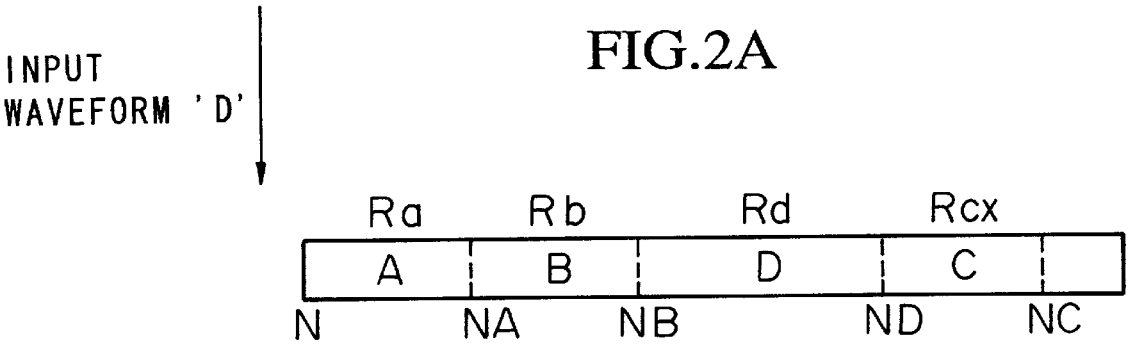
Figure 2C:
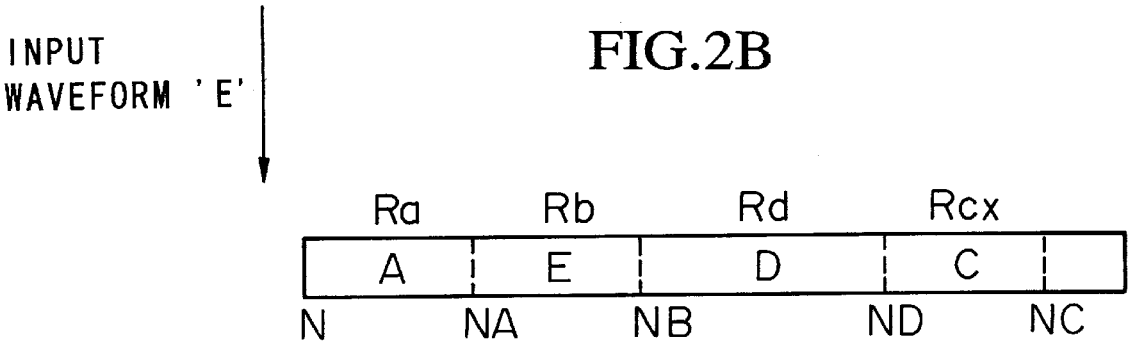
Figure 7:
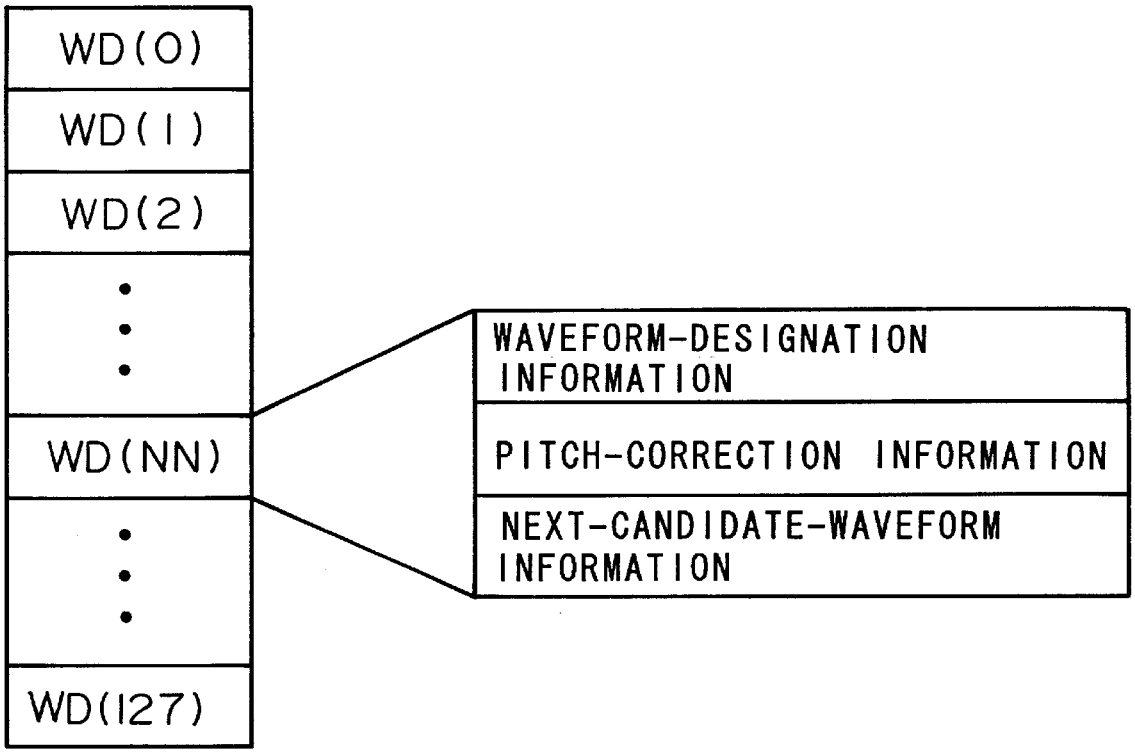
FIG. 7 is a drawing showing a structure of a division-data table.

In the above-mentioned writing operations, the CPU 11 uses the RAM 13 as a work memory so as to perform a specific processing of defining a "note name" (or "note number") representative of the waveform data, so that waveform-designation information is created and is written into a division-data table as shown in FIG. 7 which will be described later. Consecutively, the CPU 11 performs another processing to divide the waveform data into a certain register based on the note name defined. The details of those processings will be described later. By performing those processings, as shown by FIGS. 2A to 2C, waveform data 'A' to 'E' are respectively allocated to registers 'Ra' to 'Re' in accordance with their note numbers, Incidentally, the contents of the division-data table is stored by the RAM 13.

When the CPU 11 detects a key-on event which occurs in the keyboard 10, the CPU 11 refers to the division-data table in response to key-on data so as to set a read address for the sound source 20. The read address is set in response to the waveform of the musical tone corresponding to the key-on data. Based on the read address given by the sound source 20, the waveform data corresponding to the key-on data are read from the waveform RAM 19. In the sound source 20, the waveform data read from the waveform RAM 19 are processed in terms of the tone color and an envelope is further imparted to the waveform data, so that the musical tone data are created. The musical tone data are converted into analog signals which are then supplied to the sound system 21, so that the sound system produces a musical tone corresponding to the waveform data read out. In the reading operations by which the waveform data are read out, the access control unit 18 continuously selects the waveform data, read from the waveform RAM 19, so that the waveform data selected are successively supplied to the sound source 20.

The panel-switch unit 15 provides a certain switch by which the waveform data to be divided into a specific register can be changed.

[B] Software processing

Next, the software processing, which is executed by the waveform-data dividing device, will be described in detail.

Figure 3:
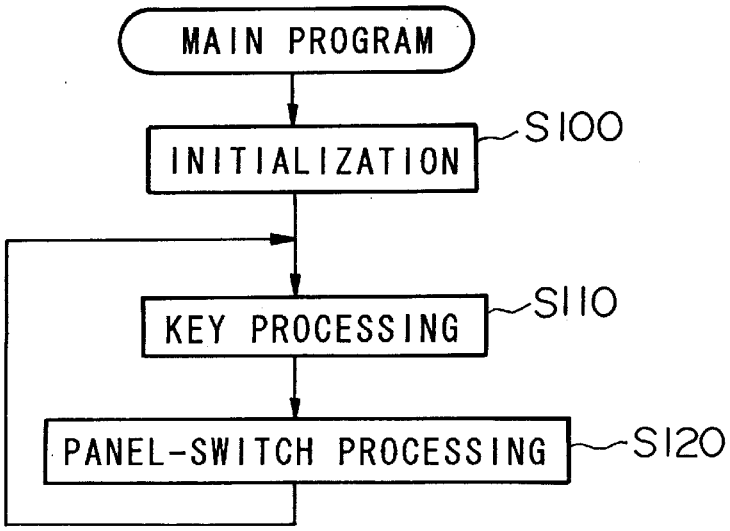
FIG. 3 is a flowchart showing a main routine to be executed by a CPU shown in FIG. 1.

FIG. 3 is a flowchart showing a main program to be executed by the CPU 11. When electric power is applied to the electronic musical instrument of FIG. 1, the CPU 11 activates execution of the main program. In step S100, initialization of the system is engaged so that a variety of registers are cleared and initial values are set to the registers or the like. In step S110, key processing is performed. In the key processing, the CPU 11 scans states of key switches, which are provided for the keys of the keyboard 10 respectively, so as to detect a change in state of the key. When the state of the key is changed from a key-off state to a key-on state, the CPU 11 instructs the sound source 20 to start generation of the musical tone which corresponds to the note number of the key depressed. On the other hand, when the state of the key is changed from a key-on state to a key-off state, the CPU 11 instructs the sound source 20 to stop generation of the musical tone corresponding to the note number of the key released; in other words, the CPU 11 instructs the sound source 20 to mute the musical tone.

In the key-on event, the CPU 11 refers to the division-data table as shown by FIG. 7 so that searching is made, using the note number corresponding to the musical tone to be produced, as to whether corresponding waveform-designation information is listed in the table. If listed, the waveform-designation information is read out and is transferred to the sound source 20. Thus, the sound source 20 reads out the waveform data, designated by the waveform-designation information, from the waveform RAM 19. Further, pitch-correction information is read from the division-data table and is transferred to the sound source 20. The pitch-correction information is used to correct the pitch of the musical tone to be produced by using interpolation technique or the like. Thus, the sound source 20 can create the musical tone data having the designated waveform and desired pitch. Based on the musical tone data, a desired musical tone is produced by the sound system 21.

If no waveform-designation information is listed in the division-data table of FIG. 7 in connection with the note number corresponding to the musical tone to be produced, the waveform-designation information is searched by changing the note number successively in a pitch-ascending order. When the CPU 11 succeeds to find out the waveform-designation information in connection with the changed note number, the waveform-designation information found is transferred to the sound source 20. In that case, the changed note number for which the waveform-designation information is found is different from the original note number corresponding to the musical tone to be produced; in other words, the changed note number is higher in pitch than the original note number because the searching is made in the pitch-ascending order. Since the sound source 20 reads out the waveform data from the waveform RAM 19 in connection with the changed note number, the pitch-correction information is read from the division-data table in connection with the changed note number as well. So, if the sound source 20 creates the musical tone data based on the waveform data corresponding to the changed note number, the musical tone is produced in the pitch which does not coincide with the pitch of the original note number. This does not meet the intention of the user. Hence, it should be changed to the pitch of the original note number. In order to do so, the present embodiment performs "conversion of pitch", employing the interpolation technique, in response to a difference between the original note number and changed note number as well as the pitch-correction information.

The original pitch of the waveform data is represented by a pair of the note number divided and the pitch-correction information. The conversion of pitch is performed by reading out the waveform data with reducing the read-out speed. In that case, in order to avoid occurrence of the folded noises, the interpolation is performed.

In next step S120, panel-switch processing is performed. Thereafter, execution of the CPU 11 returns back to the step S110. Thus, the steps S110 and S120 are repeated. In the panel-switch processing, the CPU 11 scans the panel switches so as to detect a change in state of the panel switch. If the state of the panel switch is changed from a panel-switch-off state to a panel-switch-on state, the CPU 11 executes a program specifically provided for the panel switch operated. Among the panel switches, there are provided a sampling switch, which designates the sampling operation, and a division-of-waveform change switch which changes the division of waveform data relating to the register. In general, the waveform data divided into the certain register are successively changed from old data to new data in accordance with a so-called "last-come first-served system". In some case, the user intends to change the waveform data divided into the certain register with another waveform data previously divided. In that case, the division-of-waveform change switch is operated. Incidentally, this switch can be also used to change the waveform data divided into the certain register with desired waveform data.

Figure 4:
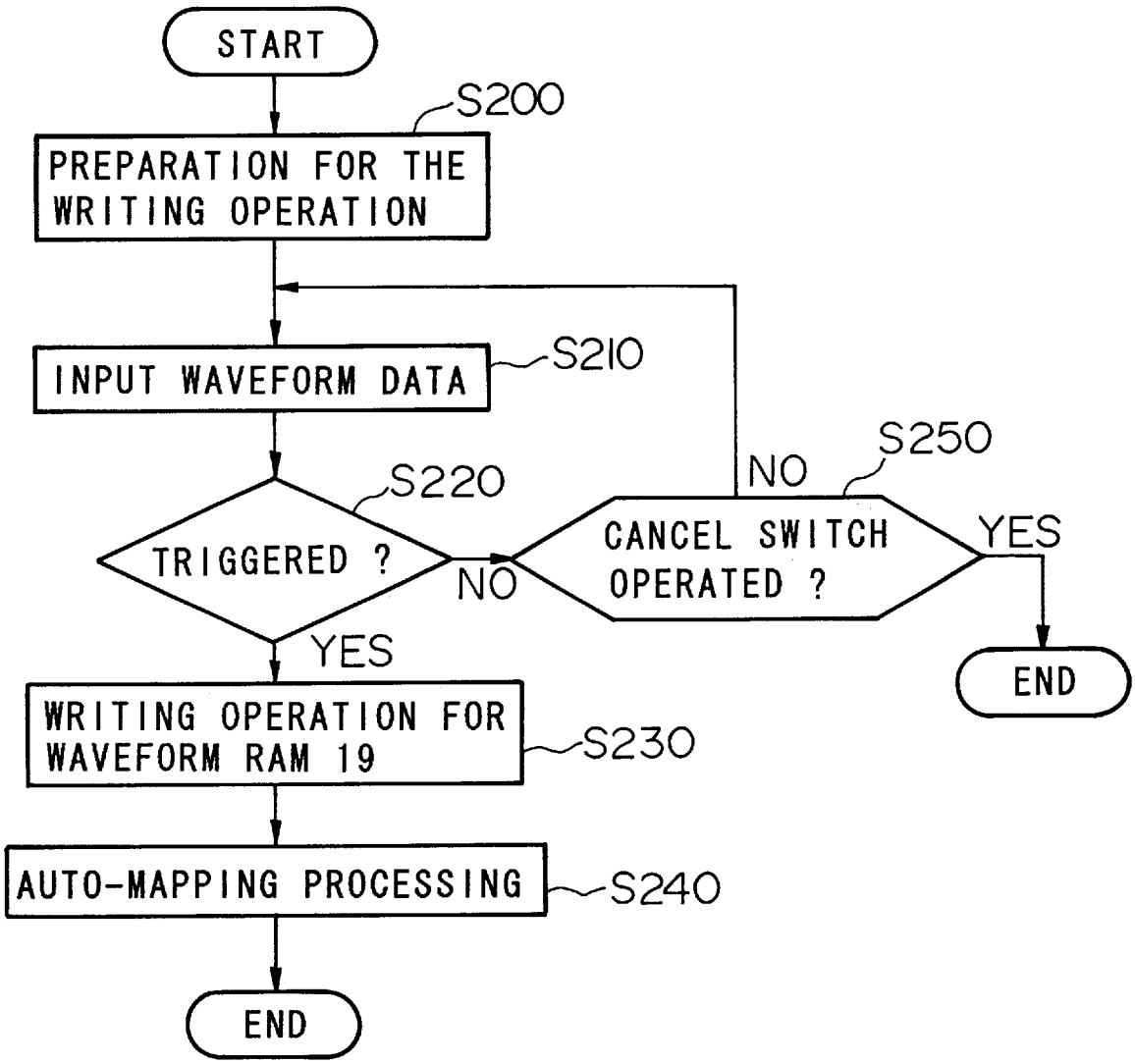
FIG. 4 is a flowchart showing a sampling-switch-on-event routine.

FIG. 4 is a flowchart showing a sampling-switch-on-event routine. In first step S200 of this routine, a preparation is made with respect to the writing operation of the waveform RAM 19. Specifically, the waveform-input unit 16 transfers a top write address to the waveform RAM 19; and a certain storage area within the waveform RAM 19 is secured to store the waveform data. In step S210, the waveform-input unit 16 inputs the waveform data. In next step S220, detection is made as to whether the writing operation for the waveform data inputted is triggered. If so, the CPU 11 proceeds to step S230 in which the writing operation for the waveform RAM 19 is performed. Incidentally, the step 220 can be designed such that the writing operation is triggered when the level of the waveform data inputted exceeds a certain level or the writing operation is started responsive to a trigger signal from an external device. As the trigger signal, it is possible to use a key-on signal produced by the keyboard 10.

When the CPU 11 does not detect a trigger event in step S220, a course of program branches from step S220 to step S250 in which detection is made as to whether a "cancel switch", which is provided within the panel switches, is operated. If so, the sampling-switch-on-event routine is canceled so that execution of this routine is ended. If not so, a branched course of program returns to the step S210. Thus, the steps S210 and S220 are repeated.

In step S230, the sampling operation is performed to obtain the waveform data which are then written into the waveform RAM 19. The writing operations for the waveform data are continued for a certain time or are continued until a stop switch is operated.

Figure 5:
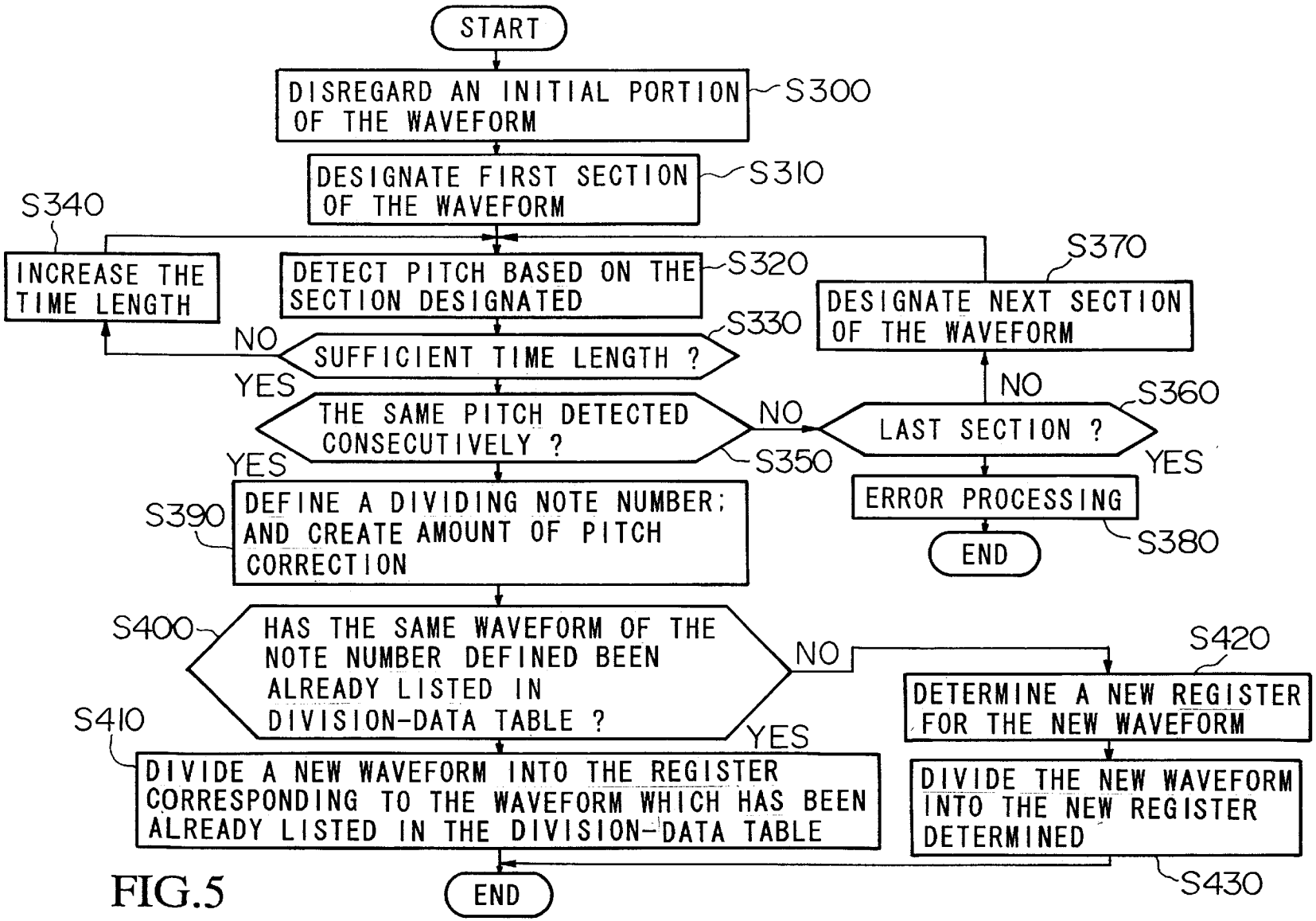
FIG. 5 is a flowchart showing an auto-mapping-processing routine.

When the writing operations for the waveform RAM 19 are completed, the CPU 11 proceeds to step S240 in which auto-mapping processing is performed. When the auto-mapping processing is completed, execution of the sampling-switch-on-even routine is ended. FIG. 5 is a flowchart showing an auto-mapping-processing routine.

When the auto-mapping-processing routine is activated, the CPU 11 firstly proceeds to step S300 in which the CPU 11 disregards an initial portion of the waveform from the pitch analysis to the waveform data. This is because the initial portion of the waveform is relatively high in content rate of higher harmonics; and such high content rate of the higher harmonics may cause a shift in pitch of the musical tone to be produced. As the method of disregarding the initial portion of the waveform, there are provided a variety of methods as follows:

In a first method, a certain initial portion of the waveform, the level of which is lower than a threshold level, is disregarded. In second method, the above initial portion plus its continuing portion corresponding to a predetermined time which starts after the level of the waveform reaches the threshold level are disregarded. In third method, a certain portion of the waveform, which exists between a waveform-start point and a peak point at which the envelope level reaches the peak, is disregarded. Thus, one of those methods can be used on demand.

Figure 8:
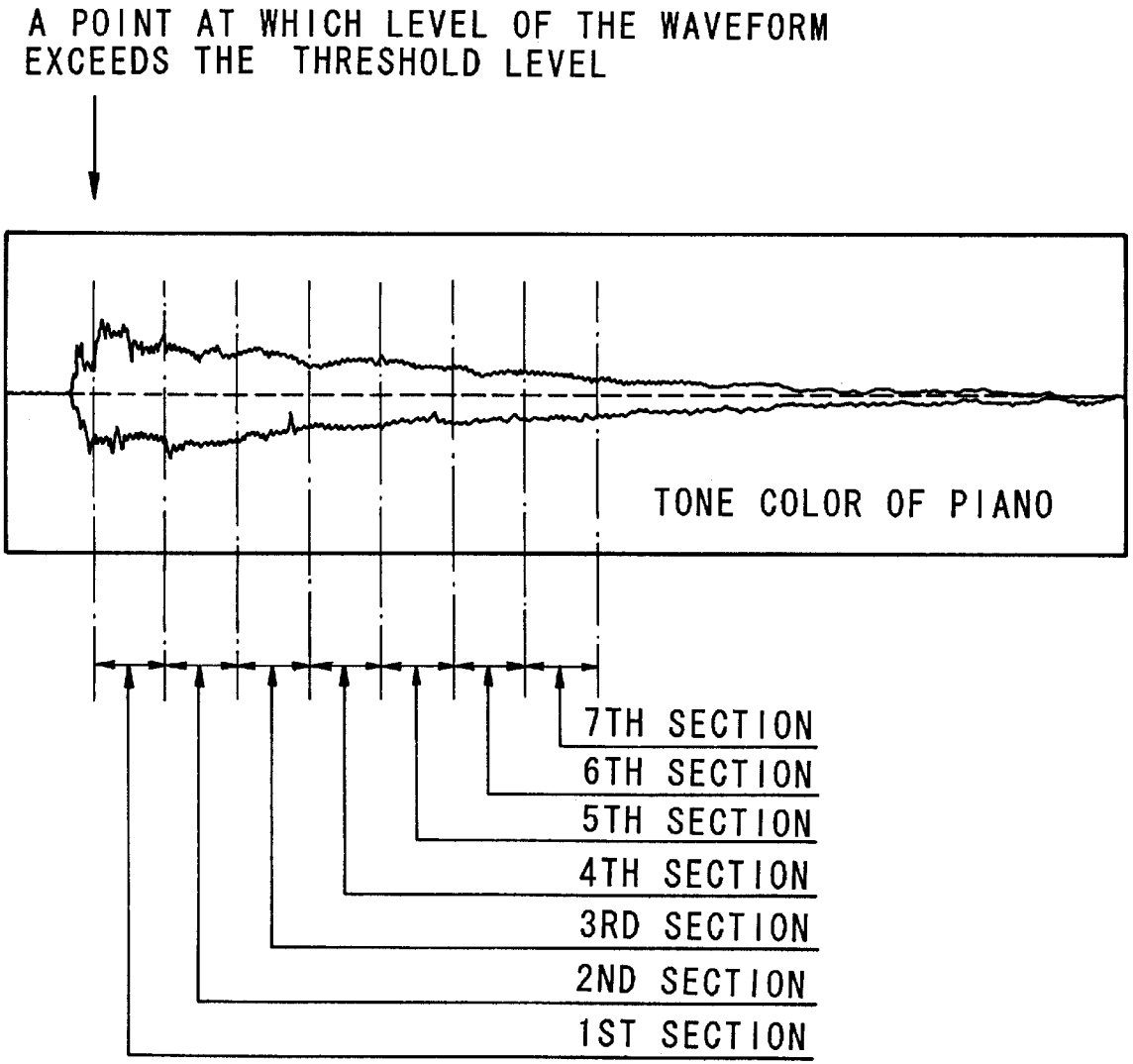
FIG. 8 is a graph showing waveforms of a piano sound.

In step S310, one waveform represented by a sequence of waveform data is divided into multiple sections as shown in FIG. 8, wherein a first section is designated as an object to be processed at first. The number of samples in this section is represented by data of about 3,000 words. In step S320, frequency analysis is performed on the first section designated so as to extract fundamental frequency, by which pitch of the waveform is detected. In step S330, a judgement is made as to whether or not the designated section of the waveform whose pitch is detected has a sufficient time length. This judgement is required because if the time length of the designated section is less than eight fundamental periods, it is not possible to securely define the pitch. If the CPU 11 judges that the designated section does not have the sufficient time length, a course of program branches to step S340 in which the time length of the designated section is increased. Then, the CPU 11 proceeds to the step S320 again, wherein detection of the pitch is performed with respect to the designated section whose time length is increased by the step S340. In the step S340, the number of words required is computed on the basis of the pitch detected so as to determine a new time length for the designated section, wherein the number of words required corresponds to the sufficient time length which is capable of containing eight periods of the waveform data. The new time length is longer than the original time length of the designated section. Thus, the step S320 performs detection of the pitch with respect to the designated section having the new time length.

Incidentally, FIG. 8 shows an input waveform having a tone color of piano, wherein a triggering operation is made at a moment when the level thereof exceeds the threshold level.

If the CPU 11 judges in step S330 that the designated section has the sufficient time length, the CPU 11 proceeds to step S350 in which a judgement is made as to whether or not the same pitch is detected with respect to two consecutive sections. In the present situation, the pitch is detected only with respect to the first section; therefore, a course of program branches to step S360 in which a judgement is made as to whether or not the section currently designated is the last section. In the present situation, the section currently designated is the first section, so that the CPU 11 proceeds to step S370. In step S370, the CPU 11 designates a next section which is consecutive to the section currently designated. Then, the CPU 11 proceeds to step S320 again, wherein a pitch is detected with respect to the next section. A sequence of steps S320 to S370 is repeated with respect to each of the sections. When the section currently designated reaches the last section, the CPU 11 proceeds to step S380 from step S360. In step S380, error processing is performed, wherein the visual display unit 14 displays an error message. The situation in which the CPU 11 proceeds to step S380 indicates that the CPU 11 cannot detect the same pitch which consecutively emerges with respect to the two consecutive sections. After completion of the error processing, the auto-mapping processing is ended.

If the step S350 judges that the same pitch is detected with respect to the two consecutive sections, the CPU 11 proceeds to step S390 in which a dividing note number is defined and an amount of pitch correction is created as well. Incidentally, the two pitches sequentially detected do not necessarily coincide with each other. For example, result of judgement of the step S350 can be set at 'YES' under the condition where pitches respectively detected for first to seventh sections belong to a certain range of pitch. Then, the pitches detected are averaged to yield an average pitch. Thereafter, the note number is defined in response to the average pitch. In general, a standard pitch of the note number defined is not equal to the pitch of the waveform detected, wherein the number of cents, corresponding to the standard pitch, represents the pitch of the temperament scale based on "A4= 440 Hz", for example. Herein, "A4" represents the scale of the tuning fork based on which the tuning is performed. Thus, a difference between them is used as the amount of pitch correction, which is then stored in the RAM 13 in step S390. Incidentally, it is not necessary to use the number of cents for the amount of pitch correction; and it is possible to use frequency instead of the number of cents.

Thereafter, the CPU 11 proceeds to step S400 in which a judgement is made as to whether the waveform RAM 19 has already stored the waveform data corresponding to the defined note number. This judgement is made with reference to the division-data table, shown by FIG. 7, particularly with reference to the waveform-designation information. If 'YES', the CPU 11 proceeds to step S410 in which a new waveform, corresponding to the note number newly defined, is divided into the register into which a certain waveform corresponding to the above waveform data has been previously divided. Thereafter, execution of the auto-mapping-processing routine is ended. On the other hand, if the CPU 11 judges that the waveform RAM 19 has not stored the waveform data corresponding to the defined note number, a course of program branches to step S420 in which the CPU 11 determines a new register for the new waveform on the basis of the defined note number. In next step S430, the new waveform is divided into the new register determined. Thereafter, execution of the auto-mapping-processing routine is ended.

Next, the structure of the division-data table will be described with reference to FIG. 7. Herein, symbols WD(0), WD(1), WD(2), . . . , WD(NN), . . . , WD(127) show division data respectively, wherein each of the numbers in parentheses, i.e., 0, 1, 2, . . . , NN, . . . , 127, represents a note number. In other words, each of the division data corresponds to each of the keys of the keyboard 10. The certain division-data WD(NN) consists of the waveform-designation information, pitch-correction information and next-waveform-candidate information. The waveform-designation information is the data which designate the waveform data corresponding to one waveform from among multiple waveforms stored by the waveform RAM 19. This data is written in the division-data table at the location corresponding to the note number which is obtained by analyzing the waveform data. If the waveform RAM 19 does not store the waveform data corresponding to the note number currently designated, a number '0' is written into the division-data table at the location corresponding to that note number. A specific pitch of the waveform data may incorporate a shift in pitch from the standard pitch of the note number defined. The pitch-correction information is the data regarding the amount of pitch correction, by which the above-mentioned shift in pitch is corrected. Further, the next-waveform-candidate information is used to designate a new waveform (see step S410) for the note number for which another waveform has been already designated. In other words, this data is used to call a next candidate of waveform, indicating the new waveform, at a moment when the waveform previously divided into a certain register is changed with the new waveform.

In the aforementioned key processing of step S110, the judgement as to whether or not the waveform-designation information exists in the division-data table is realized by the judgement as to whether or not data other than '0' is written as the waveform-designation information at the location of the note number corresponding to the musical tone to be produced.

FIGS. 2A to 2C show a manner of waveform division regarding a relationship between the waveform data and note numbers in connection with registers of keyboard. In those figures, a variety of waveforms are arranged in connection with the registers defined by the note numbers, wherein the note number written at the right is higher in pitch than the note number written at the left. In a first state shown by FIG. 2A, a waveform 'A' is divided into a register 'Ra' which exists between note numbers 'N' and 'NA'; a waveform 'B' is divided into a register 'Rb' which exists between note numbers 'NA' and 'NB'; and a waveform 'C' is divided into a register 'Rc' which exists between note numbers 'NB' and 'NC'. Thus, the musical tone is generated using the waveform A with respect to the register Ra; the musical tone is generated using the waveform B with respect to the register Rb; and the musical tone is generated using the waveform C with respect to the register Rc. Such manner of waveform division is required to avoid occurrence of the folded noises as described before. In the case of FIG. 2A, the waveform-designation information regarding the waveform A is written in the division-data table at the location of the note number NA; the waveform-designation information regarding the waveform B is written at the location of the note number NB; and the waveform-designation information regarding the waveform C is written at the location of the note number NC; and the data '0' is written at any one of the locations of the note numbers other than the above note numbers NA, NB and NC.

When a new waveform 'D' is inputted, the first state of FIG. 2A is changed to a second state of FIG. 2B. In the second state of FIG. 2B, the aforementioned register Rc is divided into two registers, i.e., 'Rd' and 'Rcx'. Hence, the new waveform D is divided into the register Rd, while the waveform C is divided into the register Rcx. Further, when another new waveform 'E' is inputted, the second state of FIG. 2B is changed to a third state of FIG. 2C. In the third state of FIG. 2C, the waveform B divided into the register Rb is changed with the waveform E. In the third state, data regarding the waveform B, which is replaced by the waveform E, is set to the next-waveform-candidate information in the division-data table.

Figure 6:
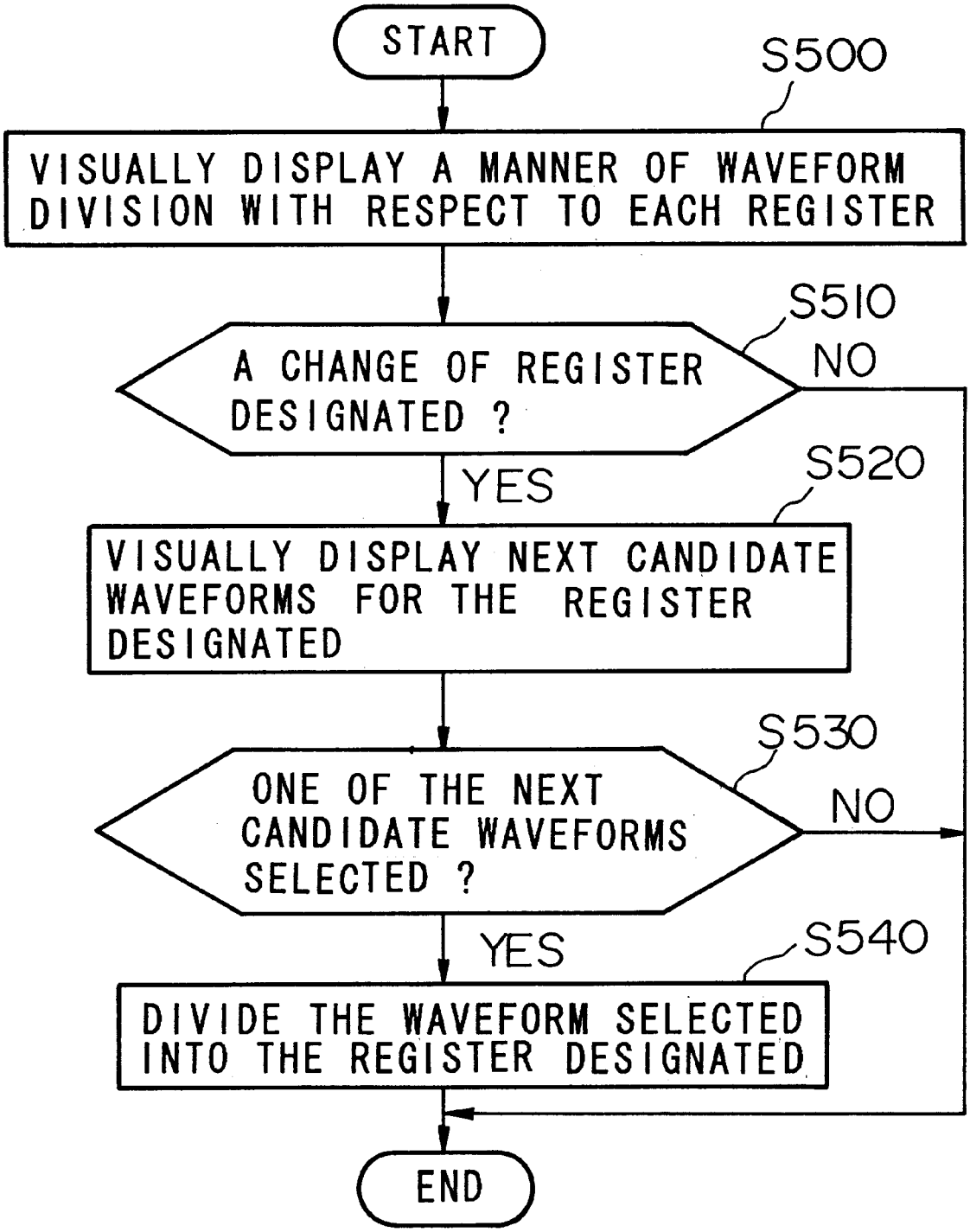
FIG. 6 is a flowchart showing a division-of-waveform-change-switch-on-event routine.

Next, a division-of-waveform-change-switch-on-event routine will be described in detail with reference to the flowchart of FIG. 6. This routine is started by operating the division-of-waveform change switch which is provided in the panel-switch unit 15.

In first step S500, the CPU 11 visually displays a state of waveform division, as shown by FIGS. 2A to 2C, with respect to each of the registers on a screen of the visual display unit 14. In next step S510, a Judgement is made as to whether or not the operator designates a certain register whose waveform should be changed. For example, if the operator designates the register Rb, into which the waveform E is currently divided, under the condition where the state of waveform division of FIG. 2C is visually displayed, the CPU 11 proceeds to step S520 in which the visual display unit 14 displays a visual image or a name of waveform corresponding to a next-candidate waveform with respect to the register designated. In this case, the waveform B, designated by the next-waveform-candidate information of the division-data table, is displayed together with the waveform D currently divided into the register Rd which is set higher than the register Rb currently designated by the operator. In other words, those two waveforms B and D are listed up as the next candidate waveforms for the register Rb. Hence, one of them is selected by the operator, so that the waveform E currently divided into the register Rb is replaced by the waveform E or D selected. In case of FIG. 2B, only one candidate waveform, i.e., waveform D, is displayed. When changing the waveform, it is desirable to perform a change between the waveforms, both of which correspond to the same note number detected, in order to avoid deterioration of the sound quality. However, in order to improve the ability of changing the waveform, the candidate waveforms contain the waveform belonging to the register which is higher in pitch than the note number detected. For example, under the condition where the manner of waveform division as shown by FIG. 2B is established, when changing the waveform D with the waveform C, the data '0' is merely written in the division-data table at the location of the note number ND. Thus, the manner of waveform division is changed from FIG. 2B to FIG. 2A.

In step S530, a Judgement is made as to whether or not one of the candidate waveforms is selected by the operator. If so, the CPU 11 proceeds to step S540 in which the waveform selected is divided into the register designated. Then, execution of this routine is ended. Similarly, when the step S510 Judges that the operator does not designate the register, the CPU 11 ends the execution of this routine.

If a time-division system is employed for the access control unit 18, it is possible to transmit the waveform data, read from the waveform RAM 19, to the sound source 20 while writing the waveform data into the waveform RAM 19.

The present embodiment is designed to perform the auto-mapping processing (i.e., processing of dividing the waveform into the register) consecutively after the sampling operation for the waveform. Regardless of the present embodiment, the present invention can be applied to a system in which the sampling waveform is analyzed to automatically designate an attack waveform and a loop waveform so that a preparation is made on reading out the loop waveform. Or, an envelope of the sampling waveform is analyzed so as to automatically create a variety of rates and level data for an envelope generator of computing type.

Lastly, the present embodiment uses the division-data table as a means of automatically dividing the waveform data into the registers. However, the structure and operation of such means are not limited to those of the division-data table.

As this invention may be embodied in several forms without departing from the spirit of essential characteristics thereof, the present embodiment is therefore illustrative and not restrictive, since the scope of the invention is defined by the appended claims rather than by the description preceeding them, and all changes that fall within meets and bounds of the claims, or equivalence of such meets and bounds are therefore intended to be embraced by the claims.

What is claimed is:

1. A waveform allocating device for use in an electronic musical instrument capable of generating a range of musical tones, said range being divided into a plurality of pitch ranges, the waveform allocating device comprising:

a waveform memory for storing unallocated waveform data corresponding to a sampled waveform;

pitch determining means for determining a pitch of the stored waveform data;

note identifier allocating means for allocating one of a plurality of predefined note identifiers to the stored waveform data in accordance with the determined pitch, each predefined note identifier corresponding to one of the pitch ranges; and means for storing the allocated note identifier in association with the stored waveform data.

2. A waveform allocating device according to claim 1, wherein the pitch determining means comprises:

dividing means for dividing at least a portion of the stored waveform data into a plurality of sections; and section pitch determining means for determining a pitch of at least two of the plurality of sections.

3. A waveform allocating device according to claim 1, wherein the pitch determining means further comprises:

means for determining a difference between the pitch determined by the pitch determining means and a a predetermined pitch associated with the note identifier allocated to the stored waveform data by the allocating means; and means for generating pitch correction data corresponding to the difference determined by the difference determining means.

4. The waveform data allocating device of claim 2, wherein the pitch determining means further includes means for detecting two consecutive sections having a pitch that falls within one of the pitch ranges, wherein the pitch of the waveform data determined by the pitch determining means corresponds to a pitch associated with the one of the pitch ranges.

5. The waveform data allocating device of claim 2, wherein the pitch determining means further includes means for determining whether a particular one of the sections is sufficiently long to accurately determine a pitch thereof.

6. The waveform data allocating device of claim 5, wherein the pitch determining means further includes means for increasing a size of the particular one of the plurality of sections if it is not sufficiently long to accurately determine a pitch thereof.

7. A waveform allocating device for use in an electronic musical instrument capable of generating a range of musical tones, said range being divided into a plurality of pitch ranges, the waveform allocating device comprising:

a waveform memory for storing unallocated waveform data representative of an input waveform;

pitch determining means for determining a pitch of the stored waveform data;

activation means for automatically activating the pitch determining means in response to the storing of waveform data in the waveform memory; and mapping means, responsive to the pitch determining means, for automatically allocating the stored waveform data to one of the pitch ranges in accordance with the pitch determined by the pitch determining means.

8. A waveform allocating method, for use in an electronic musical instrument having a waveform memory and being capable of generating a range of musical tones, said range being divided into a plurality of pitch ranges, the waveform allocating method comprising the steps of:

determining a pitch of newly input waveform data;

determining one of the pitch ranges to which the newly input waveform data should be allocated in accordance with the determined pitch of the newly input waveform data;

determining whether other waveform data are allocated to the determined pitch range;

changing an allocation associated with the determined pitch range so that the newly input waveform data are allocated to the determined pitch range if it is determined that other waveform data are allocated to the determined pitch range; and allocating the newly input waveform data to the determined pitch range if it is determined that other data are not allocated to the determined pitch range.

9. A waveform allocating device for use in an electronic musical instrument having a waveform memory and being capable of generating a range of musical tones, said range being divided into a plurality of pitch ranges, the waveform allocating device comprising:

allocation data table means for storing allocation data, the allocation data table means including a plurality of locations each corresponding to one of the pitch ranges;

pitch determining means for determining a pitch of newly input waveform data;

allocating means for determining a location in the allocation data table means corresponding to the determined pitch of the input waveform data;

determining means for determining whether the location corresponding to the determined pitch of the newly input waveform data is already associated with other waveform data; and changing means for changing an allocation associated with the determined location so that the newly input waveform data is allocated to the determined location if it is determined that the determined location is already associated with another waveform data.

10. A waveform allocating device according to claim 6, wherein the pitch determining means comprises:

dividing means for dividing at least a portion of the newly input waveform data into a plurality of sections; and section pitch determining means for determining a pitch of at least two of the plurality of sections.

11. A waveform data allocating device according to claim 9 further comprising:

display means for displaying a representation of at least one of the locations of the allocation data table means;

location selecting means for allowing an operator to select one of the locations by selecting one of the at least one displayed representations;

waveform candidate indicating means for indicating at least one candidate waveform;

waveform candidate selecting means for allowing an operator to select one of the at least one candidate waveforms indicated by the waveform candidate indicating means; and changing means for changing allocation data associated with the selected location so that the selected candidate waveform is allocated to the selected location.

12. A waveform data allocating device according to claim 6 wherein the waveform memory and the allocation data table means comprise independent memories.

13. The waveform data allocating device of claim 10, wherein the pitch determining means further includes means for determining an average of the at least two pitches determined by the section pitch determining means, wherein the pitch of the waveform data determined by the pitch determining means corresponds to the average.

14. The waveform data allocating device of claim 10, wherein the pitch determining means further includes means for detecting two consecutive sections having a pitch that falls within one of the pitch ranges, wherein the pitch of the waveform data determined by the pitch determining means corresponds to a pitch associated with the one of the pitch ranges.

15. A waveform allocating device for use in an electronic musical instrument capable of generating a range of musical tones, said range being divided into a plurality of pitch ranges, the waveform allocating device comprising:

a waveform memory for storing waveform data corresponding to a sampled waveform;

pitch determining means for determining a pitch of the stored waveform data;

note identifier allocating means for allocating one of a plurality of predefined note identifiers to the stored waveform data in accordance with the determined pitch, each predefined note identifier corresponding to one of the pitch ranges; and means for storing the allocated note identifier in association with the stored waveform data, wherein the pitch determining means comprises:

dividing means for dividing at least a portion of the stored waveform data into a plurality of sections;

section pitch determining means for determining a pitch of at least two of the plurality of sections; and means for determining an average of the at least two pitches determined by the section pitch determining means, wherein the pitch of the waveform data determined by the pitch determining means corresponds to the average.

* * * * *